US009831058B2

(12) United States Patent
Smith et al.

(10) Patent No.: US 9,831,058 B2
(45) Date of Patent: Nov. 28, 2017

(54) VACUUM ASSEMBLIES AND METHODS OF FORMATION

(71) Applicant: VAREX IMAGING CORPORATION, Salt Lake City, UT (US)

(72) Inventors: David Craig Smith, Herriman, UT (US); Christopher Price, Tooele, UT (US); Derek Bullock, West Jordan, UT (US); James E. Burke, Glenview, IL (US)

(73) Assignee: VAREX IMAGING CORPORATION, Salt Lake City, UT (US)

( * ) Notice: Subject to any disclaimer, the term of this patent is extended or adjusted under 35 U.S.C. 154(b) by 75 days.

(21) Appl. No.: 14/601,427

(22) Filed: Jan. 21, 2015

(65) Prior Publication Data

US 2016/0211105 A1 Jul. 21, 2016

(51) Int. Cl.

| | |
|---|---|
| ***H01J 5/22*** | (2006.01) |
| ***H01J 35/18*** | (2006.01) |
| ***H01J 9/385*** | (2006.01) |
| ***H01J 9/40*** | (2006.01) |
| ***H01J 35/08*** | (2006.01) |
| ***H01J 35/16*** | (2006.01) |
| *H01J 7/18* | (2006.01) |
| *H01J 35/20* | (2006.01) |

(52) U.S. Cl.

CPC ..... *H01J 5/22* (2013.01); *H01J 9/385* (2013.01); *H01J 9/40* (2013.01); *H01J 35/08* (2013.01); *H01J 35/16* (2013.01); *H01J 35/18* (2013.01); *H01J 7/18* (2013.01); *H01J 35/20* (2013.01); *H01J 2209/26* (2013.01)

(58) Field of Classification Search

CPC ..... H01J 5/22; H01J 7/18; H01J 7/22; H01J 9/26; H01J 9/38; H01J 9/385; H01J 9/40; H01J 35/00; H01J 35/02; H01J 35/06; H01J 35/16; H01J 35/165; H01J 35/18; H01J 35/20

See application file for complete search history.

(56) References Cited

U.S. PATENT DOCUMENTS

| | | | | |
|---|---|---|---|---|
| 3,147,053 A | | 9/1964 | Phelps et al. | |
| 4,400,824 A | * | 8/1983 | Shidara | H01J 35/08 313/311 |
| 4,736,400 A | * | 4/1988 | Koller | B23K 15/0046 228/262.72 |

(Continued)

FOREIGN PATENT DOCUMENTS

| | | |
|---|---|---|
| CN | 101789344 A | 7/2010 |
| GB | 1107775 A | 3/1968 |

(Continued)

*Primary Examiner* — David E Smith

(74) *Attorney, Agent, or Firm* — Maschoff Brennan

(57) ABSTRACT

The disclosed subject matter includes devices and methods relating to vacuums and vacuum assemblies. In some aspects, methods and devices relate to a vacuum assembly including a body defining an evacuated vacuum chamber, a conduit in the body extending between the vacuum chamber and an exterior of the body, a plug at least partially occluding the conduit, and a seal between the plug and the body that seals the vacuum chamber from the exterior of the body.

20 Claims, 8 Drawing Sheets

(56) References Cited

U.S. PATENT DOCUMENTS

| | | | | | |
|---|---|---|---|---|---|
| 5,107,187 | A * | 4/1992 | Miscikowski | H01C 1/14 | 315/326 |
| 5,173,836 | A * | 12/1992 | Tomase | G01L 9/0042 | 29/25.41 |
| 5,541,975 | A * | 7/1996 | Anderson | H01J 35/106 | 378/130 |
| 5,552,670 | A * | 9/1996 | Heider | C04B 37/025 | 313/623 |
| 5,733,162 | A * | 3/1998 | Benz | H01J 35/10 | 445/28 |
| 6,015,325 | A * | 1/2000 | Inazuru | H01J 35/165 | 228/187 |
| 6,041,100 | A * | 3/2000 | Miller | H01J 35/101 | 378/141 |
| 6,415,016 | B1 * | 7/2002 | Chornenky | A61N 5/1001 | 378/121 |
| 6,478,213 | B1 * | 11/2002 | Higgins | B23K 1/0008 | 228/126 |
| 2007/0278401 | A1 * | 12/2007 | Finlay | H01J 49/0022 | 250/289 |

FOREIGN PATENT DOCUMENTS

| | | | |
|---|---|---|---|
| WO | 0262421 | A1 | 8/2002 |
| WO | 2005098893 | A1 | 10/2005 |

* cited by examiner

VACUUM ASSEMBLIES AND METHODS OF FORMATION

BACKGROUND

This disclosure generally relates to vacuum assemblies. Vacuum assemblies may be used in a variety of applications such as x-ray tubes, microwave tubes, thermionic valve assemblies, lightning arrestors, vacuum circuit breakers, as well as others.

The claimed subject matter is not limited to embodiments that solve any disadvantages or that operate only in environments such as those described above. This background is only provided to illustrate examples of where the present disclosure may be utilized.

SUMMARY

This disclosure generally relates to vacuum assemblies and methods of forming vacuum assemblies.

In some aspects, a method for forming a vacuum in a vacuum assembly may include providing the vacuum assembly defining an internal vacuum chamber in fluid communication with an exterior of the vacuum assembly via a conduit in the vacuum assembly between the vacuum chamber and the exterior of the vacuum assembly. The method may include positioning a plug to at least partially occlude the conduit such that at least one space between the plug and the vacuum assembly permits fluid to travel between the vacuum chamber and the exterior of the vacuum assembly. The method may include evacuating the vacuum chamber so that gas in the vacuum chamber exits the vacuum chamber through at least one space between the plug and the vacuum assembly. The method may include sealing the evacuated vacuum chamber with the plug such that the vacuum chamber is sealed from the exterior of the vacuum assembly. In one aspect, the vacuum assembly may be heated under vacuum in order to obtain the sealing of the vacuum chamber.

In one example embodiment, a vacuum assembly may include a body defining a vacuum chamber, a conduit in the body extending between the vacuum chamber and an exterior of the body, and a plug at least partially occluding the conduit so as to form at least one space between the plug and the body.

In another example embodiment, a kit may include a vacuum assembly including a body defining a vacuum chamber in fluid communication with an exterior of the vacuum assembly via a conduit in the body between the vacuum chamber and the exterior of the vacuum assembly, and a plug configured to be positioned to at least partially occlude the conduit such that at least one space between the plug and at least one wall of the conduit permits gaseous fluid to be evacuated from the vacuum chamber and does not permit at least some particles to enter the vacuum chamber.

In yet another example embodiment, a vacuum assembly may include a body defining an evacuated vacuum chamber, a conduit in the body extending between the vacuum chamber and an exterior of the body, a plug at least partially occluding the conduit, and a seal between the plug and the body that seals the vacuum chamber from the exterior of the body.

This Summary introduces a selection of concepts in a simplified form that are further described below in the Detailed Description. This Summary does not indicate key features, essential characteristics, or the scope of the claimed subject matter.

DETAILED DESCRIPTION

Figure 1:
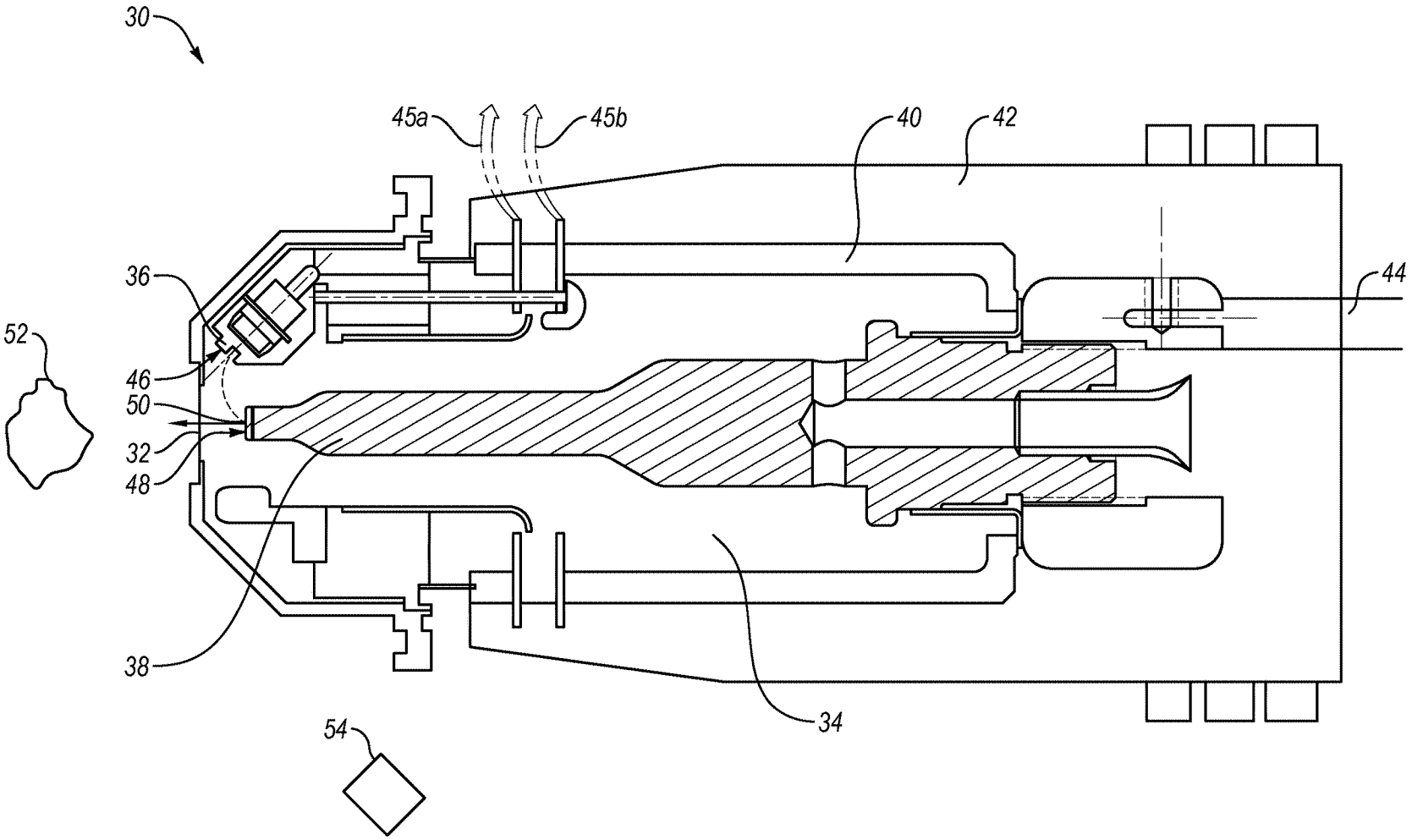
FIG. 1 is a view of an embodiment of an X-ray assembly.

Reference will now be made to the figures wherein like structures will be provided with like reference designations. The drawings are non-limiting, diagrammatic, and schematic representations of example embodiments, and are not necessarily drawn to scale.

This disclosure generally relates to vacuum assemblies. Vacuum assemblies may be used in a variety of applications such as x-ray tubes, microwave tubes, thermionic valve assemblies ("vacuum tubes"), lightning arrestors, vacuum circuit breakers, as well as others. As used in this disclosure, "vacuum assembly" refers to any structure, assembly, device, and/or feature defining a vacuum chamber, as well as associated structures, assemblies, devices, and/or features, as may be indicated by context.

In some technical fields, the term "vacuum" may be used to refer to a space that is entirely devoid of matter. For example, such a definition may be used by physicists to discuss ideal test results that would occur in a theoretical perfect vacuum. In such circumstances, the term "partial vacuum" may be used to refer to actual imperfect vacuums that may simulate conditions similar to a perfect vacuum. In many other technical fields, the term "vacuum" may be used to refer to chambers with an internal pressure less than atmospheric pressure, sometimes referred to as "negative pressure." In this disclosure, the term "vacuum" or "partial vacuum" may be used interchangeably to refer to chambers with negative pressure, unless context clearly indicates otherwise.

The quality or level of a partial vacuum may refer to how closely it approaches a perfect vacuum. A low internal pressure of a chamber may indicate a higher quality vacuum, and vice versa. Examples of lower quality vacuums include a typical vacuum cleaner or a vacuum insulated steel thermos. A typical vacuum cleaner may produce enough suction to reduce air pressure by around 20%.

Such vacuum levels may be sufficient for many applications, but much higher quality vacuums may be required in other applications. For example, X-ray assemblies for X-ray fluorescence instruments may require vacuum chambers with relatively high quality vacuums. The X-ray assemblies may generate X-rays directed at samples to obtain information about the samples. However, if X-ray assemblies have vacuum chambers with low quality vacuums, the X-ray assemblies may generate spectral impurities that may interfere with obtaining information about the samples. Specifically, X-ray assemblies with low quality vacuums may include substances such as particles and/or gases inside the vacuum chambers that may cause the X-ray assemblies to emit radiation with undesirable characteristics (e.g., wavelength, energy level, etc.).

In some circumstances, producing X-ray assemblies having vacuum chambers with high quality vacuums may be expensive and/or impracticable given the production processes used to form X-ray assemblies. Additionally or alternatively, some processing stages of forming high quality vacuums may have the potential of damaging portions of X-ray assemblies and/or decreasing operational characteristics of X-ray assemblies.

Aspects of the vacuum assemblies and associated methods described herein may facilitate producing high quality vacuum chambers suitable for X-ray assemblies. The illustrated X-ray assemblies generally may include cathode assemblies and anode assemblies housed within the vacuum assemblies. Such X-ray assemblies may generate relatively low levels of spectral impurities. Nevertheless, the illustrated X-ray assemblies illustrate only some example applications and operating environments of aspects of this disclosure. The vacuum assemblies and related concepts disclosed in this application may be applied in other operating environments such as microwave tubes, thermionic valve assemblies, lightning arrestors, vacuum circuit breakers, as well as many others.

FIG. 1 illustrates an example of an X-ray assembly 30 for an X-ray fluorescence instrument. The X-ray assembly 30 includes a body extending between a first end and a second end. An X-ray emission window 32 may be positioned at the first end of the X-ray assembly 30. A cathode assembly 36 and an anode assembly 38 may be housed within a vacuum chamber 34 of the X-ray assembly 30. The X-ray assembly 30 may be an X-ray source and/or an X-ray tube. The X-ray assembly 30 may generate X-rays directed at samples to obtain information about the samples.

The cathode assembly 36 may include an electron emitter such as cathode filament. The electron emitter may be formed of any suitable material, such as tungsten. A first electrical coupling and a second electrical coupling may be positioned on opposing sides of the electron emitter to permit electricity to flow through the electron emitter. The first and second electrical couplings may electrically couple the electron emitter to the filament leads 45*a* and 45*b*.

The anode assembly 38 may include a target 50 positioned near the X-ray emission window 32 and spaced apart from the X-ray emission window 32. The vacuum chamber 34 may be defined by portions of the X-ray assembly 30 such as the interior body 40, the anode assembly 38, and/or other portions. The interior body 40 may be an electrical insulator or a high voltage insulator. The interior body 40 may be surrounded by an exterior body 42 that may include a potting material forming a portion of the X-ray assembly 30. An anode lead 44 may be electrically coupled to the anode assembly 38. At least one energy detector 54 may be positioned near a sample 52 to receive radiation from the sample 52.

In operation, the electron emitter may generate a flux of electrons that may travel various paths. An electrical current may be applied between the first and second electrical couplings resulting in electrons colliding with the electron emitter positioned in between. The electrons may then be ejected from the electron emission face 46 of the cathode assembly 36 and the electrons may then travel toward the target 50.

Electrons emitted as an electron beam from an electron emission face 46 of the cathode assembly 36 may travel toward the target 50 having an X-ray emission face 48, which is part of the anode assembly 38. The electrons in the electron beam are shown by the dashed line between the electron emission face 46 and the target 50. The electrons may be attracted to the anode assembly 38 because it is positively charged. Some of the electrons that collide with the X-ray emission face 48 of the target 50 may generate X-rays. The X-rays emitted from the X-ray emission face 48 are indicated by the arrow extending therefrom. The X-ray emission window 32 may permit some of the X-rays to travel from the X-ray assembly 30 toward the sample 52. When electrons collide with the X-ray emission face 48, the characteristics of the emitted radiation (e.g. wavelength, frequency, photon energy, and/or other characteristics) may depend on the composition of the target 50 and/or the voltage of the anode assembly 38.

Some of the generated X-rays may travel from the X-ray emission face 48 of the target 50, through the X-ray emission window 32 and to the sample 52. Depending on the properties of the sample 52 and the wavelength of the X-rays, some of the X-rays projected on the sample 52 may pass through the sample 52, some may be absorbed by the sample 52, and/or some may be reflected by the sample 52. The energy detector 54 may detect some of the energy emitted (or fluoresced) from the irradiated sample 52, and information about the sample 52 may be obtained.

For example, when the sample 52 is exposed to radiation such as X-rays with energy greater than the ionization potential of atoms of the sample 52, the atoms may become ionized and eject electrons. In some circumstances, the X-rays may be energetic enough to expel tightly held electrons from the inner orbitals of the atoms. This may make the electronic structure of the atoms unstable, and electrons in higher orbitals of the atoms may "fall" into the lower orbital to fill the hole left behind. In falling, energy may be released in the form of radiation, the energy of which may be equal to the energy difference of the two orbitals involved. As a result, the sample 52 may emit radiation, which has energy characteristics of its atoms, and some of the emitted radiation may be received by the energy detector 54.

The energy detector 54 may receive radiation including radiation emitted from the sample 52. The energy detector may detect characteristics of the received radiation, such as energy level, wavelength, or other characteristics. The characteristics of the received radiation may be used to determine characteristics of the sample 52. For example, in some configurations, the characteristics of the received radiation may be used to determine aspects of the material composition of the sample 52. In some configurations, the sample 52 may be positioned within a vacuum chamber (not shown) to be irradiated.

As illustrated, the electron emission face 46 of the cathode assembly 36 and/or the X-ray emission face 48 of the anode assembly 38 may be generally oriented towards the X-ray emission window 32. Such configurations may also permit the X-ray emission face 48 to be positioned close to the sample 52 without contacting the X-ray emission window 32. Positioning the X-ray emission face 48 close to the sample 52 may permit stronger and/or shorter wavelength X-rays to be projected onto the sample 52 and/or may decrease dissipation and/or scattering of the X-rays. Positioning the X-ray emission face 48 close to the sample 52 may result in higher intensity X-rays to be projected onto the sample 52. Additionally or alternatively, such configurations may permit the energy detector 54 to be positioned close to the sample 52 to improve reception of energy radiated from the sample 52.

Figure 2A:
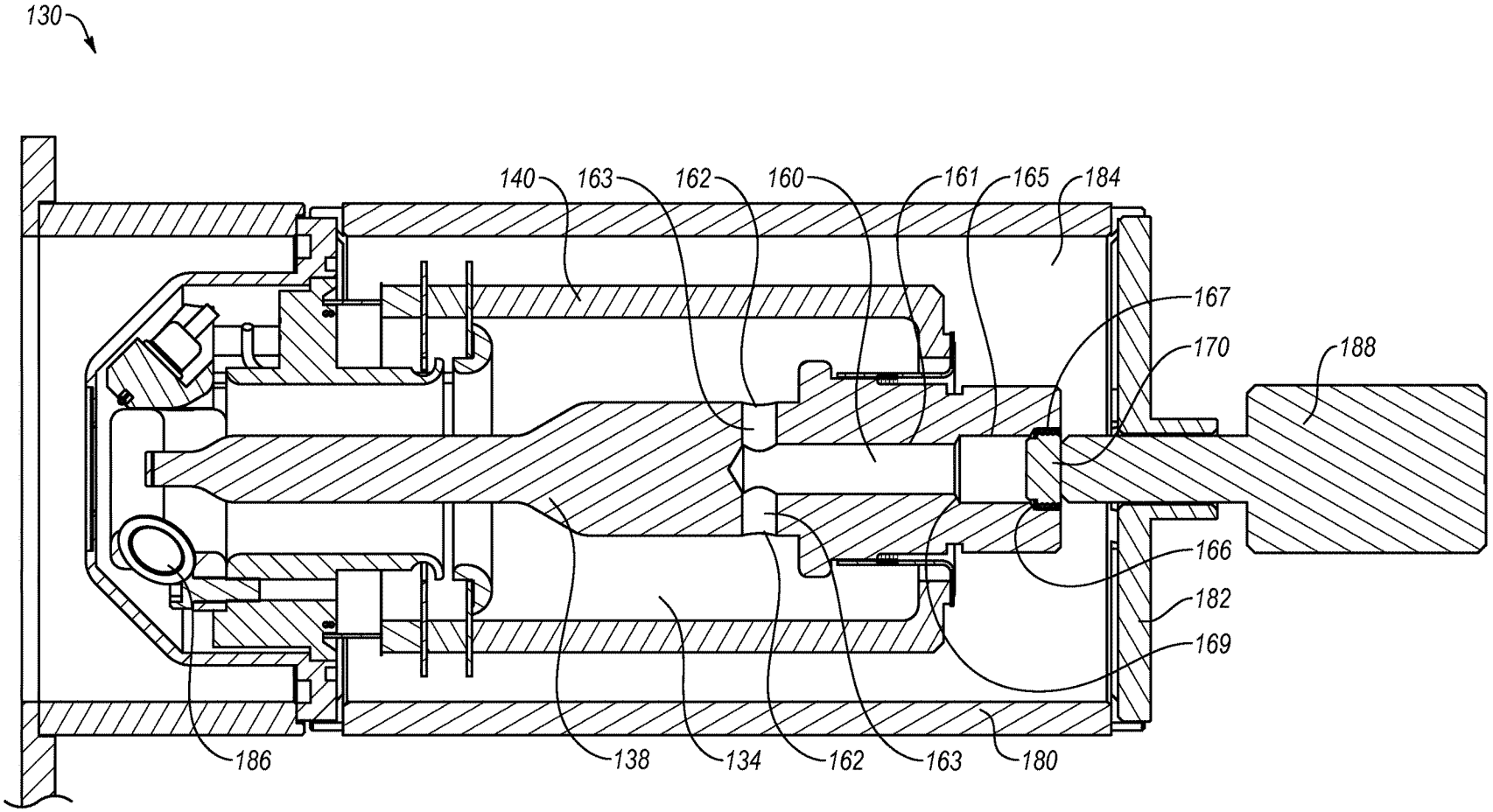
FIG. 2A is a cross-sectional view of another embodiment of an X-ray assembly.
Figure 2B:
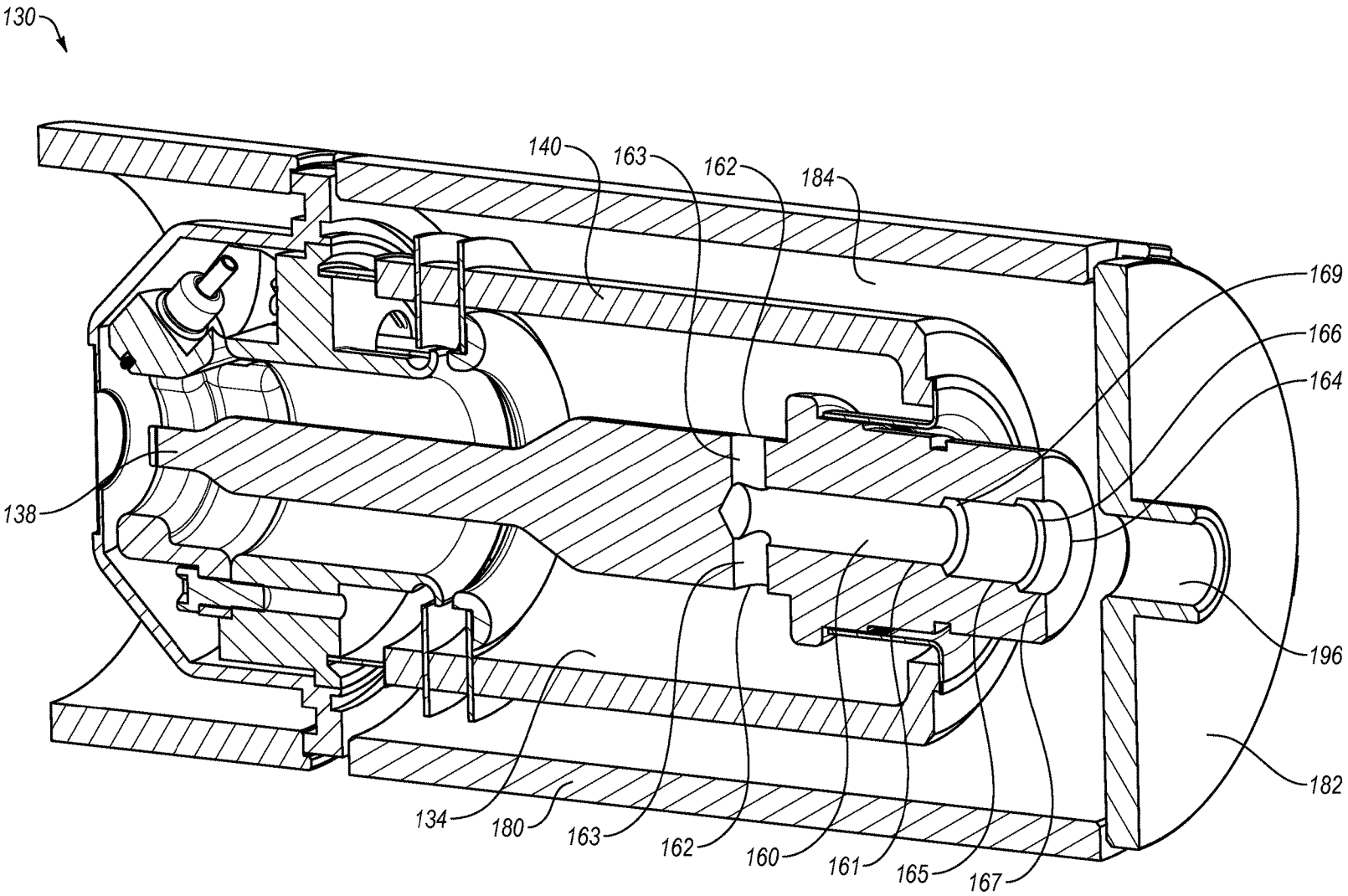
FIG. 2B is a cross-sectional perspective view of the X-ray assembly of FIG. 2A with some features omitted.
Figure 3A:
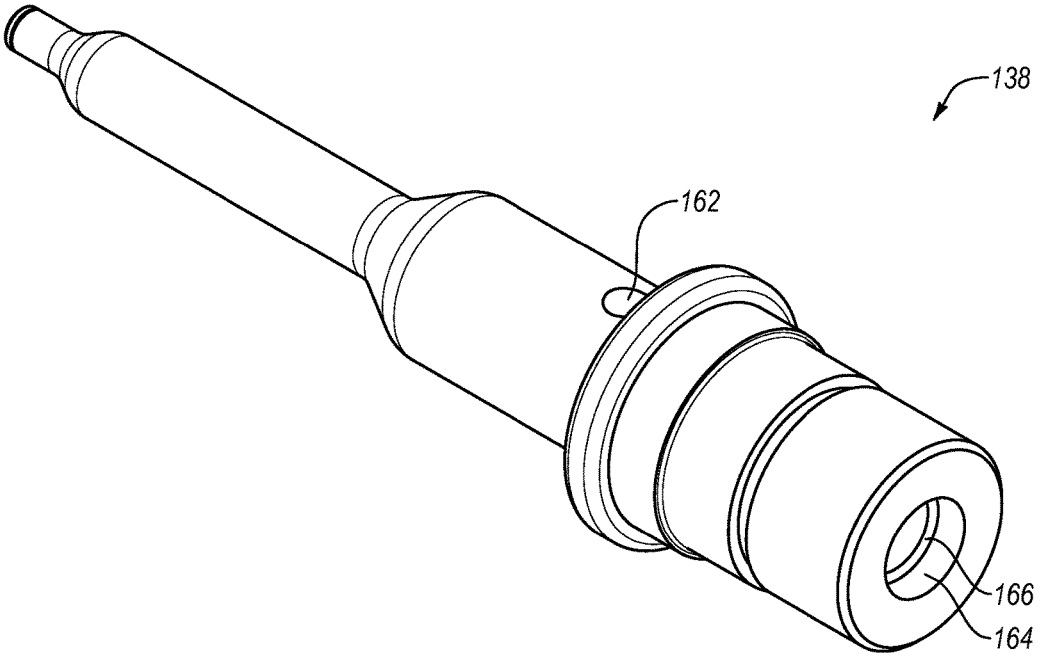
FIG. 3A is a perspective view of an embodiment of an anode assembly of the X-ray assembly of FIGS. 2A-2B.
Figure 3B:
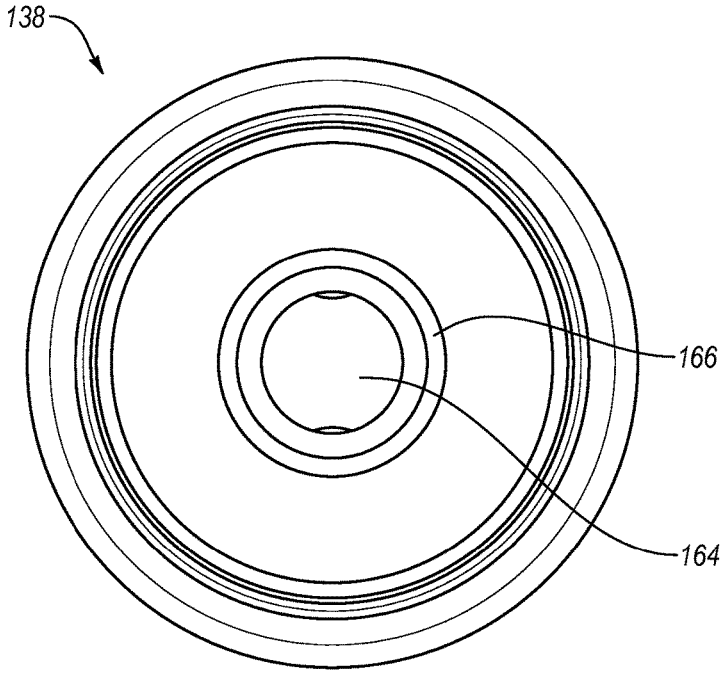
FIG. 3B is an end view of the anode assembly of the X-ray assembly of FIGS. 2A-2B.

FIG. 2A illustrates a cross-sectional view of another example of an X-ray assembly 130 for an X-ray fluorescence instrument. FIG. 2B illustrates a cross-sectional perspective view of the X-ray assembly of FIG. 2A with some features omitted. The X-ray assembly 130 may include aspects similar to or the same as those of the X-ray assembly 30. For clarity and brevity, descriptions of some similar or identical components may be omitted. Some similar or identical components of the X-ray assembly 130 may include similar numbering as the X-ray assembly 30, as will be indicated by context.

The X-ray assembly 130 may include an interior body 140 at least partially surrounding an anode assembly 138. A vacuum chamber 134 may be defined by portions of the X-ray assembly 130 that may include the interior body 140 and the anode assembly 138. The anode assembly 138 may include a conduit 160 with one or more first openings 162 in fluid connection with the vacuum chamber 134. The configuration of the conduit 160 may permit gaseous fluids to travel in and/or out of the vacuum chamber 134. A plug 170 may partially (e.g., before forming the vacuum) or entirely (e.g., after forming the vacuum) occlude the conduit 160. In circumstances where the plug 170 entirely occludes the conduit 160, the plug 170 may seal the conduit 160 thereby precluding gaseous fluids to travel in and/or out of the vacuum chamber 134 through the conduit 160.

A housing 180 may surround at least a portion of X-ray assembly 130 within a housing chamber 184. In the illustrated example, the housing 180 surrounds the interior body 140 and a portion of the anode assembly 138, although other configurations are contemplated. The housing 180 includes a housing end 182 with an opening 196 sized and/or shaped to receive a driving member 188. The driving member 188 may be configured to be used in forming the X-ray assembly 130. For example, the driving member 188 may be configured to facilitate positioning of the plug 170 to occlude the conduit 160. In one form, the driving member 188 may be a weighted driving member 188 that interfaces with the plug 170 and employs gravitational force to facilitate aspects of forming the X-ray assembly 130, such as driving the plug 170 to occlude the conduit 160, as will be described in further detail below. In some configurations, the housing 180 may be used during production of the X-ray assembly 130. For example, the housing 180 may be configured to retain at least a portion of the X-ray assembly 130 during manufacturing stages such as assembly, evacuation, sealing, and/or other stages. The housing 180 may be removed after one of the steps of the production of the X-ray assembly 130 and may not be included in the completed X-ray assembly 130. In such configurations, FIGS. 2A-2B may illustrate the X-ray assembly 130 during formation. Once the X-ray assembly 130 is formed, it may include aspects illustrated with respect to the X-ray assembly 130 of FIG. 1. In other configurations, at least a portion of the housing 180 may remain as part of the completed X-ray assembly 130.

The X-ray assembly 130 may include a getter 186 positioned inside of the vacuum chamber 134 and configured to generate and/or maintain a vacuum within the vacuum chamber 134. For example, the getter 186 may include a material that reacts with gas molecules to remove gas from the vacuum chamber 134 to generate and/or maintain a vacuum. In some configurations, the getter 186 may be a coating applied to a surface within the vacuum chamber 134. The getter 186 may be configured to be selectively activated and/or deactivated. For example, the getter 186 may be configured to be activated at a specific temperature or temperature range. In another example, the getter 186 may be configured to be activated by an electrical current. If the getter 186 is configured to be selectively activated, the getter 186 may be deactivated during certain manufacturing stages of the X-ray assembly 130. For example, the getter 186 may be deactivated during some or all manufacturing stages before the vacuum chamber 134 is sealed. The getter 186 may be activated after certain manufacturing stages of the X-ray assembly 130. For example, the getter 186 may be activated during or after the vacuum chamber 134 is sealed. In another example, the getter 186 may be activated after the X-ray assembly 130 is completely formed. The getter 186 may be a flashed getter, non-evaporable getter, coating getter, bulk getter, getter pump, sorption pump, ion getter pump, and/or other suitable getter type. In some configurations, the X-ray assembly 130 may include one or more getters of different types.

With combined reference to FIGS. 2A-2B and 3A-3B, the anode assembly 138 will be described in further detail. As illustrated, the conduit 160 may extend between the first openings 162 and a second opening 164. The conduit 160 may include radially extending portions 163 that terminate at the first openings 162. The first openings 162 may permit gaseous fluids to travel between the vacuum chamber 134 and the conduit 160. The conduit 160 may include a first portion 161, a second portion 165 and a third portion 167 extending longitudinally through the anode assembly 138 between the radially extending portions 163 and a second opening 164. The second opening 164 may permit gaseous fluids to travel in and/or out of the conduit 160. A first taper 169 may be positioned between the first portion 161 and the second portion 165. The taper 169 may be configured to narrow the conduit 160 such that the second portion 165 includes at least one dimension (e.g. width, thickness, height, diameter, cross-sectional dimension, cross-sectional area, etc.) greater than a corresponding dimension (e.g. width, thickness, height, diameter, cross-sectional dimension, cross-sectional area, etc.) of the first portion 161. A second taper 166 may be positioned between the second portion 165 and the third portion 167. The taper 166 may be configured to narrow the conduit 160 such that the third portion 167 includes at least one dimension (e.g. width, thickness, height, diameter, cross-sectional dimension, cross-sectional area, etc.) greater than a corresponding dimension (e.g. width, thickness, height, diameter, cross-sectional dimension, cross-sectional area, etc.) of the second portion 165.

The conduit 160 may be configured (e.g., sized and/or shaped) to receive the plug 170 and the taper 166 may be configured to interface with the plug 170, as will be described in further detail below. The anode assembly 138 may be formed of any suitable materials. The anode assembly 138 may include materials with relatively high thermal conductivity. For example, the anode assembly 138 may include copper or a copper alloy.

Although in the illustrated example the conduit 160 includes a specific configuration, the conduit 160 may include any suitable configurations. For example, the conduit 160 may include more or less first openings 162 and/or corresponding radially extending portions 163. In another example, the conduit 160 may include more or less tapers similar to the tapers 166, 169. In some forms, the tapers 166, 169 may include alternatively configurations. For example, the tapers 166, 169 may extend further through the conduit 160. In some configurations, the tapers 166, 169 may narrow and/or widen the conduit 160 greater or less than illustrated. In some configurations, one or more of the first portion 161, the second portion 165, and/or the third portion 167 may be tapered. In some configurations, the entire longitudinally extending portion of the conduit 160 including the first portion 161, the second portion 165, and/or the third portion 167 may be tapered.

Figure 4A:
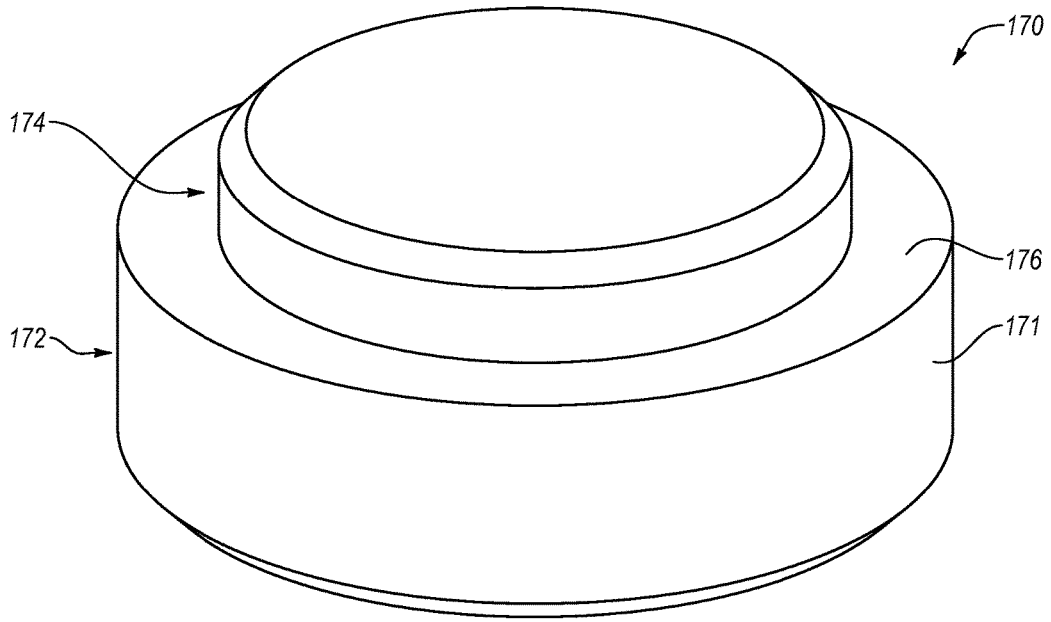
FIG. 4A is a perspective view of an embodiment of a plug of the X-ray assembly of FIGS. 2A-2B.
Figure 4B:
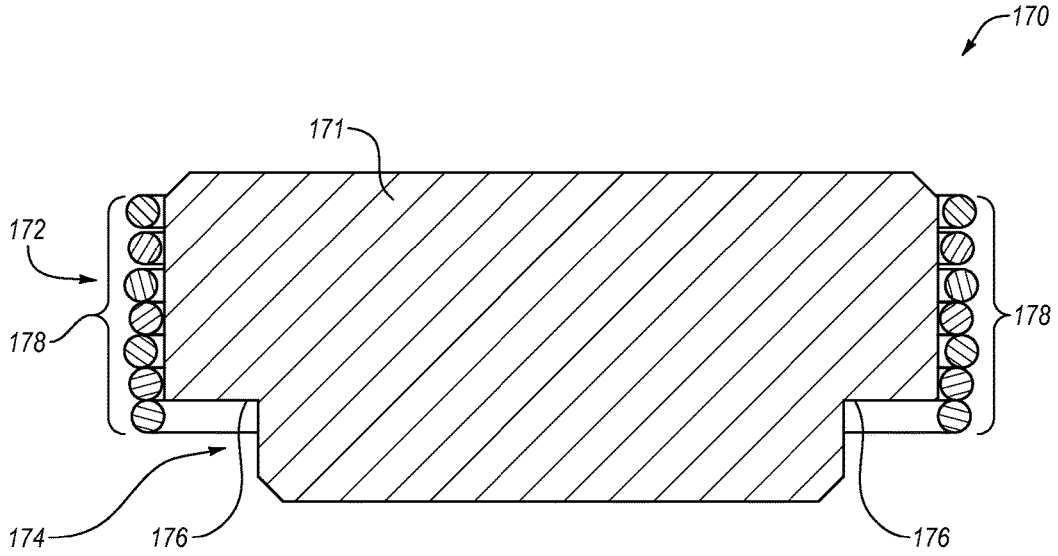
FIG. 4B is cross-sectional side view of the plug of the X-ray assembly of FIGS. 2A-2B.

As illustrated for example in FIGS. 2A-2B, the plug 170 may be configured to partially or entirely occlude the conduit 160 at the taper 166, the third portion 167, and/or at the second opening 164. In other configurations, the plug 170 may be configured (e.g., shaped and/or dimensioned) to be received at the taper 169 to seal the conduit 160. Turning to FIGS. 4A-4B, the plug 170 will be described in further detail. FIG. 4A illustrates a perspective view of the plug 170. As illustrated, the plug 170 may include a plug body 171 extending between a first portion 172 and a second portion 174. The plug 170 may define a shoulder 176 positioned on the first portion 172 adjacent to the second portion 174. The second portion 174 may include cross-sectional dimensions smaller than corresponding dimensions of the first portion 172. Specifically, if the plug 170 is circular as illustrated, the second portion 174 may include a circumference and/or a diameter smaller than a corresponding circumference and/or diameter of the first portion 172.

Although the plug 170 illustrated is circular, in other configurations the plug 170 may be square, rectangular, multifaceted, oval, multilateral, or any suitable geometric configuration. In some circumstances, circular or spherical plugs may be less expensive to produce and/or simplify the production process of vacuum assemblies. In some circumstances, decreasing the number of edges of a plug 170 may facilitate the production process of vacuum assemblies. In other configurations, the plug 170 may include portions of any suitable shapes, sizes, or corresponding dimensions. For example, the first portion 172 and/or the second portion 174 may include rectangular, square, multifaceted, oval, and/or other geometric configurations, or any combination thereof. In further configurations, the plug 170 may not include first and second portions 172, 174. For example, the plug 170 may be spherical or may have continuous sides. In another example, the plug 170 can include only the first portion 172, and the second portion 174 may be omitted (e.g., plug 170 configured as a cap). Alternatively, the plug 170 may include only the second portion 174, and the first portion may be omitted (e.g., plug 170 configured as a cork). Also, the plug body 171 may have various recesses or protrusions or other texture on the perimeter surface (insert element number) that are not shown, such as the perimeter of the first portion 172, second portion 174 or the shoulder 176.

The plug body 171 may be formed of any suitable materials. The plug body 171 may include materials with relatively high thermal conductivity. For example, the plug body 171 may include copper or a copper alloy. In some configurations, the material of the plug body 171 may be selected to include properties similar to properties of the material of the anode assembly 138. For example, the material of the plug body 171 may include thermal expansion characteristics similar or the same as the material of the anode assembly 138. In other configurations, the material of the plug body 171 may include thermal expansion characteristics different than the material of the anode assembly 138. In some forms, dissimilar thermal expansion materials may be used to increase or decrease spaces between the anode assembly 138 and the plug 170 when heated, as described below with respect to FIGS. 6A-6E.

As illustrated for example in FIG. 4B, the plug 170 may include interface members 178. In some configurations, the interface members 178 may be rings or annular members or threading or protrusions and/or recesses or the like encircling at least a portion of the plug body 171. For example, as illustrated, the interface members 178 may surround at least some of the first portion 172 of the plug 170. In non-illustrated configurations, the interface members 178 may extend to the shoulder 176 and/or the second portion 174 of the plug 170. The interface members 178 may be configured to be positioned at the interface between the plug 170 and the conduit 160, as will be described in further detail below with respect to FIGS. 5A-5C.

As illustrated, one or more of the interface members 178 may be spaced from one another and/or the plug body 171. The spaces between the interface members 178 and/or the plug body 171 may permit gaseous fluid to pass through. The spacing of each interface members 178 and one another and/or the plug body 171 may vary. For example, the spacing between each of the interface members 178 and the plug body 171 may be different for each of the interface members 178. In another example, the spacing between each of the interface members 178 and the plug body 171 may vary around the circumference of the plug body 171. In another example, the spacing between one of the interface members 178 and other interface members 178 may be different than the spacing between other interface members 178. The variable spacing of the interface members 178 may be formed from variations in the formation of the plug 170. In some example embodiments, the variable spacing of the interface members 178 may be in a range between 0 and 9 thousandths of an inch ("thou"), between 0 and 10 thou, between 0 and 15 thou, and/or between 0 and 90 thou. In other example embodiments, the variable spacing of the interface members 178 may be in a range of 9, 10, 15, and/or 90 thou plus and/or minus 1%, 5%, 10%, 25%, 50%, 75%, and/or 100%.

The interface members 178 may include a meltable material configured to form a bond when heated. For example, the interface members 178 may be formed of braze material, a solder material, or other suitable material. If the interface members 178 are to be brazed, the material of the interface members 178 may include a braze alloy. In some configurations, the interface members 178 may include a copper alloy, a silver alloy, a gold alloy, or other suitable material. In some configurations, the braze alloy may be configured to form bonds at temperatures below 800° C. In some configurations, the braze alloy may include a melting point below 800° C. In some configurations, the braze alloy may be configured to form bonds at temperatures between 450° C. and 500° C. In some configurations, the braze alloy may include a melting point between 450° C. and 500° C. In some circumstances, some braze alloys may not be used because of production factors. For example, some braze alloys may be expensive. In another example, some braze alloys may not be used because they include materials unsuitable for the production processes such as zinc, cadmium and/or others because they include high vapor pressures.

In some embodiments, the interface members 178 may be formed of one or more bands or wires surrounding the plug body 171. For example, a wire may be wrapped spirally (e.g., threading) around the plug body 171 to form a spring-shaped interface member. Such configurations may include spacing between portions of the interface members 178 defining a spiral path that permits gaseous fluid to pass through. In yet another embodiment, the interface members 178 may be material deposited on portions of the plug body 171. The deposited material may include spacing, threads, surface imperfections, or other features that permit gaseous fluid to pass through. In still other embodiments, the interface members 178 may be included as part of the anode assembly 138 rather than the plug 170. For example, the interface members 178 may be coupled to the walls of the conduit 160.

With reference to FIGS. 2, 3A-3B and 4A-4B, additional details regarding formation of the X-ray assembly 130 will be discussed. At least some portions of the X-ray assembly 130 illustrated in FIGS. 2, 3A-3B and 4A-4B may be provided and/or assembled. Specifically, at least some portions of the X-ray assembly 130 defining the vacuum chamber 134 may be provided and/or assembled. In one example, at least the anode assembly 138 and the interior body 140 may be provided and/or assembled. The getter 186, which may be in its deactivated state, may be coupled to the X-ray assembly 130 inside of the vacuum chamber 134.

All or portions of the X-ray assembly 130 (e.g., the plug 170, the anode assembly 138, and/or other portions) may be prepared for processing in a vacuum furnace. All or portions of the X-ray assembly 130 may be cleaned to remove particulates and/or impurities. For example, impurities may be removed from the vacuum chamber 134, the housing chamber 184, the surface of the anode assembly 138 (see for example FIG. 2), and/or the surface of other portions of the X-ray assembly 130. At least a portion of the X-ray assembly 130 preparation may take place in a clean room environment.

Figure 5A:
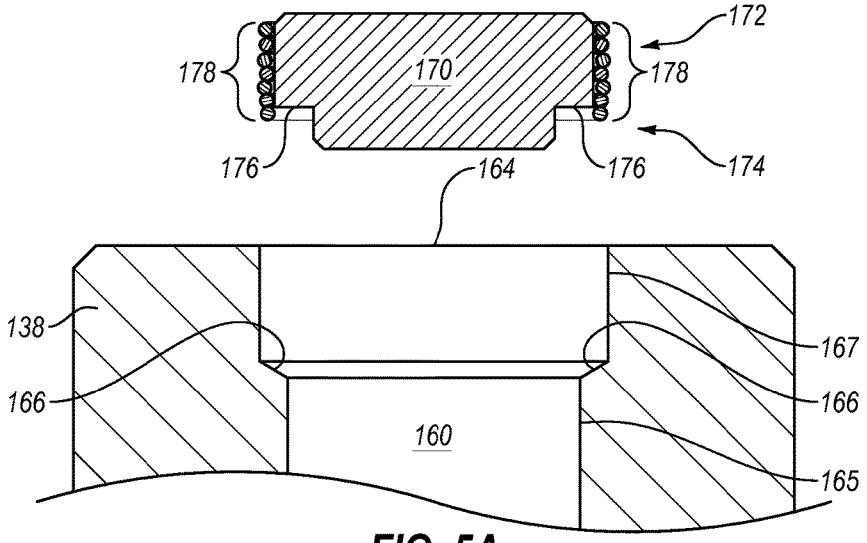
FIGS. 5A-5C are cross-sectional views of a portion of the X-ray assembly of FIGS. 2A-2B.
Figure 5B:
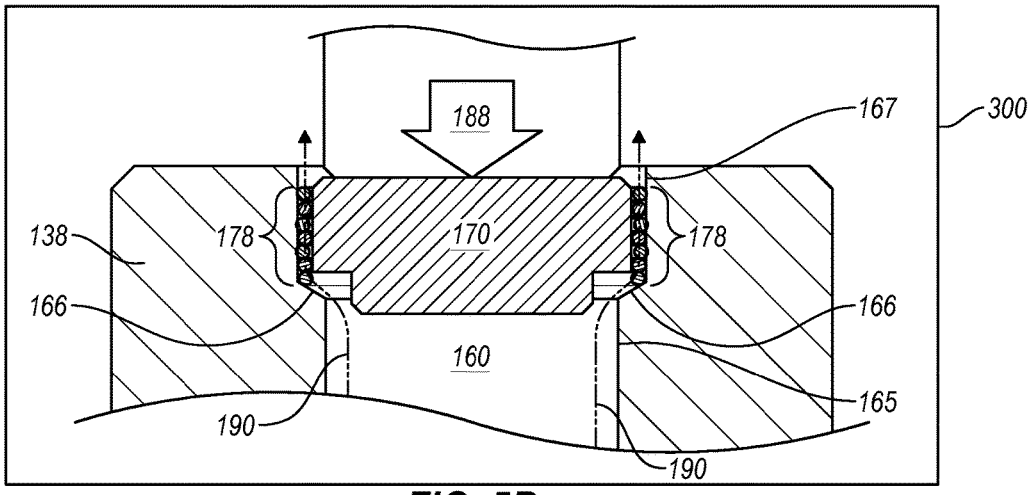
Figure 5C:
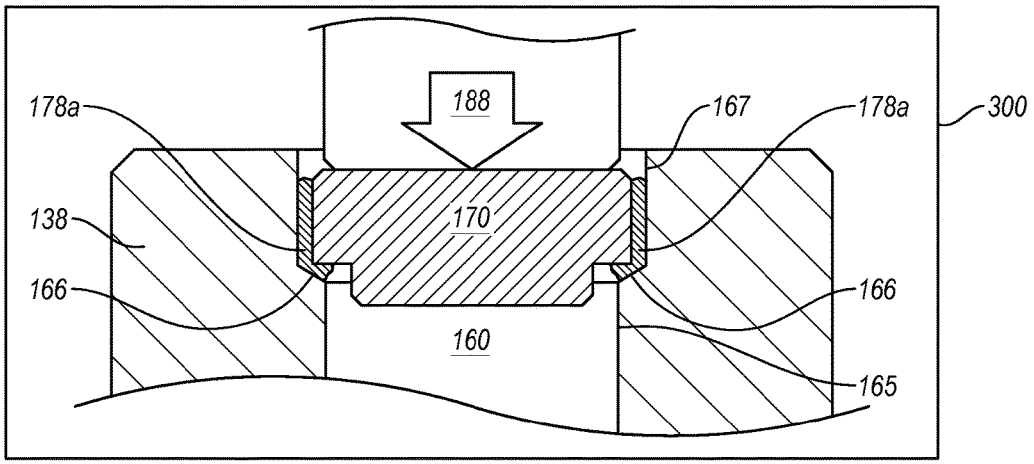

Turning to FIGS. 5A-5C, additional details regarding formation of the X-ray assembly 130 will be discussed. FIG. 5A illustrates the plug 170 and a portion of the anode assembly 138 in further detail. As illustrated, the plug 170 and the anode assembly 138 may be separate from one another prior to being inserted into a vacuum furnace for further processing.

As illustrated in FIGS. 5A-5C, the plug 170 and/or the conduit 160 may be configured (e.g., sized and shaped) such that the plug 170 may be positioned inside of the conduit 160. For example, the first portion 172 of the plug 170 may include at least one cross-sectional dimension less than a corresponding cross-sectional dimension of the third portion 167 of the conduit 160. In configurations where the plug 170 includes interface members 178, the interface members 178 may contribute to the cross-sectional dimension of the plug 170. In another example, the second portion 174 of the plug 170 may include at least one cross-sectional dimension less than a corresponding cross-sectional dimension of the second portion 165 of the conduit 160. In non-illustrated configurations, the plug 170 may be configured to be positioned inside of the conduit 160 after the walls of the conduit 160 are heated at least at the second portion 165 and the third portion 167.

Turning to FIG. 5B, the plug 170 may be positioned inside of the conduit 160. In some configurations, the plug 170 and/or the conduit 160 may be configured (e.g., sized and shaped) such that spacing between the first portion 172 of the plug 170 and the third portion 167 of the conduit 160 is sufficiently small to form a braze bond of suitable strength. In some configurations, spacing between the first portion 172 of the plug 170 and the third portion 167 of the conduit 160 may be in a range between 0 and 9 thou, between 0 and 10 thou, between 0 and 15 thou, and/or between 0 and 90 thou. In other configurations, spacing between the first portion 172 of the plug 170 and the third portion 167 of the conduit 160 may be less than 9, 10, 15, and/or 90 thou plus and/or minus 1%, 5%, 10%, 25%, 50%, 75%, and/or 100%.

As illustrated, the spacing between the second portion 174 of the plug 170 and the second portion 165 of the conduit 160 may be greater than the spacing between the first portion 172 of the plug 170 and the third portion 167 of the conduit 160. In other configurations, the spacing between the second portion 174 of the plug 170 and the second portion 165 of the conduit 160 may be substantially the same or less than the spacing between the first portion 172 of the plug 170 and the third portion 167 of the conduit 160. Also, the spacing may be relative between the plug 170 and the first portion 161 and the second portion 165.

The configuration of the plug 170 may facilitate positioning the plug 170 through the second opening 164 into the conduit 160. For example, as illustrated, at least one cross-sectional dimension of the second portion 174 of the plug 170 may be less than at least one cross-sectional dimension of the first portion 172 of the plug 170. Such configurations may facilitate positioning the plug 170 through the second opening 164 because the cross-sectional dimension of the second portion 174 is substantially less than at least one cross-sectional dimension of the third portion 167 of the conduit 160.

In some configurations, the positioning of the plug 170 may occur in a clean room environment. As illustrated, the conduit 160 may be configured to prevent the plug 170 from being inserted further into the conduit 160. Specifically, the second portion 165 of the conduit 160 may include at least one cross-sectional dimension less than a corresponding cross-sectional dimension of the first portion 172 if the plug 170. In such configurations, the shoulders 176 and/or the interface members 178 may incident the taper 166 thereby preventing the plug 170 from being further inserted. In the illustrated position, the interface members 178 of the plug 170 interface with the third portion 167 of the conduit 160 and the taper 166, although other configurations are contemplated. For example, the interface members 178 may be configured not to interface with the taper 166.

As discussed above with respect to FIG. 4B, the interface members 178 are spaced apart from one another and the plug body 171. The interface members 178 may also be spaced apart from the walls of the conduit 160 at the third portion 167 of the conduit 160 and/or the taper 166 when the plug 170 is positioned in the conduit 160, as illustrated. As indicated by arrows 190, the configuration of the interface members 178 may permit gaseous fluid to travel through the conduit 160 and around the plug 170. Specifically, gaseous fluid may travel between the second portion 165 of the conduit 160 and the second portion 174 of the plug 170 and between the third portion 167 of the conduit 160 and the first portion 172 of the plug 170. In such configurations, the vacuum chamber 134 may be in fluid communication with the housing chamber 184 or other portions of the X-ray assembly 130, thereby permitting gaseous fluids and/or other substances to be evacuated from the vacuum chamber 134.

The spacing between respective interface members 178 may be such that particles and/or contaminants of a certain size are not permitted to travel into the vacuum chamber 134. For example, the spacing of the interface members 178 may be large enough to permit gaseous fluid to pass around the plug 170 between the third portion 167 of the conduit 160 and the first portion 172 of the plug 170, yet small enough such that particles of a certain size are not permitted to pass around the plug 170. Such configurations may permit evacuation of the vacuum chamber 134 without permitting contaminants to enter the vacuum chamber 134. The spacing of the interface members 178 may be configured to permit the vacuum chamber 134 to be evacuated at a certain rate. For example, the spacing of the interface members 178 may be large enough to permit gaseous fluid to pass around the plug 170 at a sufficient flow rate given the equipment selected to evacuate the vacuum chamber 134. Such configurations may permit evacuation of the vacuum chamber 134 at a suitable rate without permitting contaminants to enter the vacuum chamber 134.

In some configurations, after the plug 170 is positioned inside of the conduit 160 of the anode assembly 138, the housing 180 may be positioned around the anode assembly 138 and the driving member 188 may be positioned against the plug 170. As indicated by the arrow, the driving member 188 may apply a force against the plug 170. The force of the driving member 188 may contribute to retaining the plug 170 inside of the conduit 160 and/or may contribute to positioning the plug 170 inside of the conduit 160. The force of the driving member 188 may be generated by the weight of the driving member 188 or other suitable drive configurations.

After the plug 170 is positioned inside of the conduit 160 (as illustrated for example in FIG. 5B), the X-ray assembly 130 may be positioned inside of a vacuum furnace 300 for further processing. The vacuum furnace 300 may evacuate the vacuum chamber 134 by pulling substances out of the vacuum chamber 134 through the conduit 160 and around the plug 170 (for example, as indicated by arrows 190). Particles and/or contaminants may not be permitted to the vacuum chamber 134 because of the configuration of the interface members 178. For example, the spacing between the interface members 178, the plug body 171, and/or the walls of the conduit 160 may be smaller than diameters of at least some contaminants, thereby preventing at least some of the contaminants from passing through the spaces. In another example, the interface members 178 may act as a filter, retaining at least some contaminants thereby preventing at least some contaminants from entering the vacuum chamber 134. In some example embodiments, the spaces configured to prevent contaminants from entering vacuum chamber 134 may be less than 9, 10, 15, and/or 90 thou. In other example embodiments, the spaces configured to prevent contaminants from entering vacuum chamber 134 may be less than 9, 10, 15, and/or 90 thou plus and/or minus 1%, 5%, 10%, 25%, 50%, 75%, and/or 100%.

During or after evacuation, the vacuum furnace 300 may heat the X-ray assembly 130. Heating may contribute in forming a bond at the interface between the plug 170 and the anode assembly 130. In one configuration, heating may soften and/or melt the material of the interface members 178. Heating the material may cause the interface members 178 to form a bond between the plug body 171 and the anode assembly 138. Depending on the configuration, the bond between the plug body 171 and the anode assembly 138 may be a braze bond, a solder bond, or any other suitable bond. The bond may form a seal 178*a* in the conduit 160 with the plug 170.

As the material softens and/or melts, the driving member 188 may continue applying force to the plug 170, pushing the plug 170 further into the conduit 160 as illustrated for example in FIG. 5C. As the plug 170 is pushed further into the conduit 160, the distance between the plug body 171 and the taper 166 decreases, and the space between the plug body 171 and the taper 166 may be filled with material. In some example embodiments, the distance between the plug body 171 and the taper 166 may decrease to a range between 0 and 9 thou, between 0 and 10 thou, between 0 and 15 thou, and/or between 0 and 90 thou. In other example embodiments, the distance between the plug body 171 and the taper 166 may decrease to 9, 10, 15, and/or 90 thou plus and/or minus 1%, 5%, 10%, 25%, 50%, 75%, and/or 100%.

As heating continues, the material may melt and fill the spaces between the plug 170 and the walls of the conduit 160. In some configurations, the spaces between the first portion 172 of the plug 170 and the walls at the third portion 167 of the conduit 160 form reservoirs of melted material. In some example embodiments, the reservoirs may include one or more dimensions less than or greater than 9, 10, 15, and/or 90 thou plus and/or minus 1%, 5%, 10%, 25%, 50%, 75%, and/or 100%.

The material and/or the X-ray assembly 130 may be cooled and a seal 178*a* may be formed. As illustrated, in some configurations the seal 178*a* is formed between the first portion 172 of the plug 170 and the walls at the third portion 167 of the conduit 160. In some circumstances, the seal 178*a* may be airtight, substantially airtight, hermetic, and/or semi-hermetic. In some example embodiments, the seal 178*a* may include one or more dimensions less than 9, 10, 15, and/or 90 thou plus and/or minus 1%, 5%, 10%, 25%, 50%, 75%, and/or 100%. In some example embodiments, the seal 178*a* may include one or more dimensions within a range of 9, 10, 15, and/or 90 thou plus and/or minus 1%, 5%, 10%, 25%, 50%, 75%, and/or 100%.

FIGS. 6A-6E illustrate section views of a portion of the X-ray assembly 130 configured to receive an alternative plug 270. In some configurations, the X-ray assembly 130 may include an anode assembly 238, a portion of which is illustrated in FIGS. 6A-6E. The anode assembly 238 may include any or all of the features described with respect to the anode assembly 138. The anode assembly 238 may define a conduit 260 with a taper 266 positioned between a third portion 267 and a second portion 265. The third portion 267 may extend between the taper 266 and a second opening 264 of the conduit 260. The conduit 260, the taper 266, the second opening 264, the second portion 265 and the third portion 267 may generally correspond to conduit 160, the taper 166, the second opening 164, the second portion 165 and the third portion 167 of the anode assembly 138. However, the conduit 260 may be configured (e.g., sized and/or shaped) to receive the plug 270 rather than the plug 170.

Figure 6A:
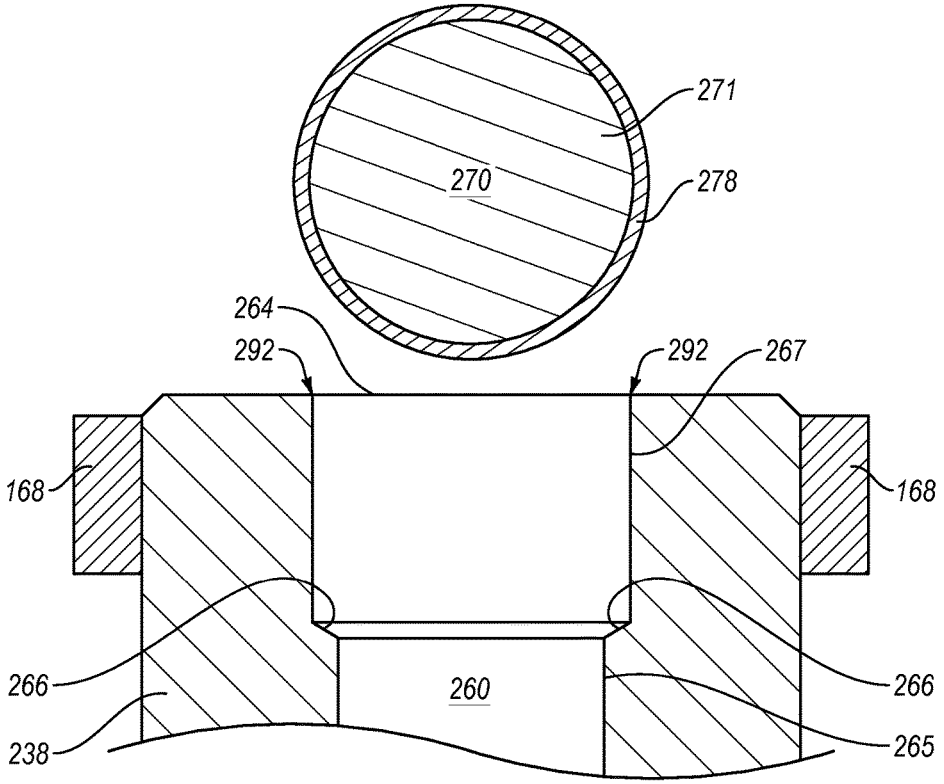
FIGS. 6A-6E are section views of another form of a portion of the X-ray assembly of FIGS. 2A-2B.

As illustrated for example in FIG. 6A, the plug 270 may include a spherical plug body 271. In some configurations, the plug 270 may include a coating surrounding the plug body 271. In the illustrated plug 270, the coating 278 surrounds the entire plug body 271. In other configurations, the coating 278 may not surround the entire plug body 271. For example, the coating 278 may be positioned on portions of the plug 270 configured to interface with the walls of the conduit 260. In non-illustrated configurations of the plug 170, the coating 278 may be included on the plug 170 instead of the interface members 178 in a substantially similar position.

Although in the illustrated configuration the plug 270 is spherical, in other configurations the plug 270 may be circular, cylindrical, square, rectangular, multifaceted, oval, multilateral, or any suitable geometric configuration. In some circumstances, circular or spherical plugs may be less expensive to produce and/or simplify the production process of vacuum assemblies. The plug 270 may be shaped and/or dimensioned similar or the same as the plug 170.

Figure 6B:
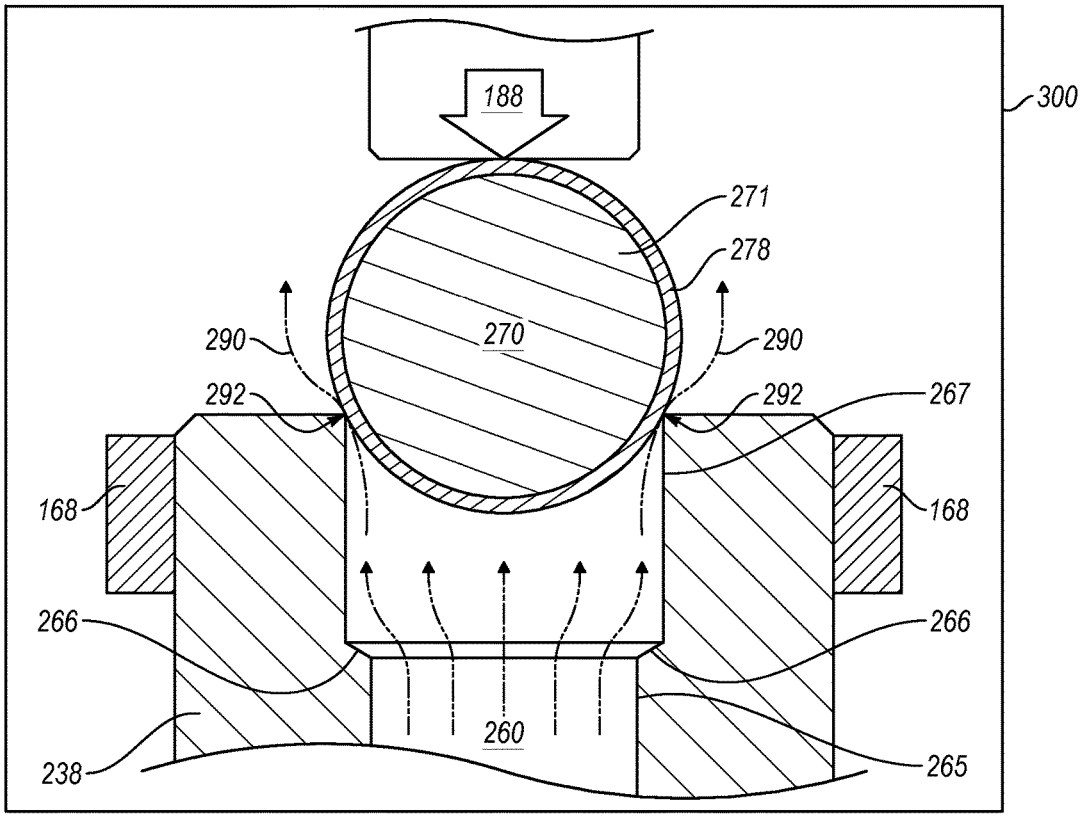

FIG. 6B illustrates the plug 270 partially positioned in the conduit 260 through the second opening 264. As illustrated, the plug 270 may be configured to be larger than the second opening 264. Specifically, at least one cross-sectional dimension of the plug 270 may be larger than at least one corresponding dimensions of the second opening 264 and/or the third portion 267. Such configurations may stop the plug 270 from being inserted entirely into the conduit 260. Specifically, the surface of the plug 270 may incident edges 292 of the anode assembly 238 positioned at the second opening 264 thereby preventing the plug 270 from being further inserted. In some configurations, the positioning of the plug 270 partially inside of the conduit 260 may occur in a clean room environment.

As illustrated, the plug 270 may rest on the edges 292 positioned at the second opening 264. The configuration of the plug 270 and the conduit 260 may permit gaseous fluid to travel through the conduit 260 and around the plug 270 as indicated by arrows 290. Such configurations may permit gaseous fluids and/or other substances to be evacuated from the vacuum chamber 134. Substances may travel through the conduit 260 and around the plug 270 via spaces (not illustrated) between the plug 270 and the anode assembly 238.

The spaces may be positioned at or near the edges 292 and/or at or near the interface between the plug 270 and the anode assembly 238. In some configurations, the spaces may be formed from imperfections on the surface of the plug 270 and/or the anode assembly 238 at the edges 292. Such imperfections may arise during forming the plug 270 and/or the anode assembly 238, for example, during ordinary production processes. In other configurations, the surface of the plug 270 and/or the anode assembly 238 may be modified such that the spaces are formed at their interface. For example, the surface of one or both of the plug 270 and the anode assembly 238 may be notched, textured, machined, or otherwise suitably modified. Specifically, the surface of the anode assembly 238 at the edges 292 may be notched, textured, machined, or otherwise suitably modified. Additionally or alternatively, in some configurations the walls of the conduit 160 at the third portion 267 may be notched, textured, machined, or otherwise suitably modified.

In some configurations, the size (e.g., one or more dimensions) of channels and/or openings may be selected such that the resulting spaces are a specified size or within a specified range of sizes. In other configurations, the surface of one or both of the plug 270 and the anode assembly 238 may be finished, burnished, and/or polished, for example, to reduce the size of the resulting spaces. In some configurations, the size of channels and/or openings may be selected such that particles or contaminants are not permitted to pass into the vacuum chamber 138. Additionally or alternatively, the size of channels and/or openings may be selected such that the vacuum chamber 138 may be evacuated at a suitable rate.

The spacing may be such that particles and/or contaminants of a certain size are not permitted to travel around the plug 270, for example, into the vacuum chamber 134 of FIG. 2. The spacing may be large enough to permit gaseous fluid to pass around the plug 270, yet small enough such that particles of a certain size are not permitted to pass around the plug 270. Such configurations may permit evacuation of the vacuum chamber 134 without permitting contaminants to enter the vacuum chamber 134. The spacing may be configured to permit the vacuum chamber 134 to be evacuated at a certain rate. For example, the spacing may be large enough to permit gaseous fluid to pass around the plug 270 at a sufficient flow rate given the equipment selected to evacuate the vacuum chamber 134. Such configurations may permit evacuation of the vacuum chamber 134 at a suitable rate without permitting contaminants to enter the vacuum chamber 134. In some example embodiments, spacing large enough to permit gaseous fluid to pass around the plug 270 at a sufficient flow rate may be in a range between 0 and 9 thou, between 0 and 10 thou, between 0 and 15 thou, and/or between 0 and 90 thou. In other example embodiments, spacing large enough to permit gaseous fluid to pass around the plug 270 at a sufficient flow rate may be in a range of 9, 10, 15, and/or 90 thou plus and/or minus 1%, 5%, 10%, 25%, 50%, 75%, and/or 100%. Forming the X-ray assembly 130 may include evacuating substances from the vacuum chamber 134 via the spaces positioned at or near the edges 292.

In some configurations, after the plug 270 is positioned at least partially inside of the conduit 260 of the anode assembly 238, the driving member 188 may be positioned against the plug 270. As indicated by arrow, the driving member 188 may apply a force against the plug 270. The force of the driving member 188 may contribute to retaining the plug 270 inside of the conduit 260 and/or may contribute to positioning the plug 270 inside of the conduit 260. The force of the driving member 188 may be generated by the weight of the driving member 188 or other suitable drive configurations.

After the plug 270 is positioned partially inside of the conduit 260 (as illustrated for example in FIG. 6B), the X-ray assembly 130 including the plug 270 and the anode assembly 238 may be positioned inside of a vacuum furnace 300 for further processing. The vacuum furnace 300 may evacuate the vacuum chamber 134 by pulling substances out of the vacuum chamber 134 through the conduit 260 and around the plug 270 (for example, as indicated by arrows 290). Particles and/or contaminants may not be permitted to the vacuum chamber 134 because of the configuration of the plug 270 and the conduit 260. For example, the spacing between the plug 270 and the anode assembly 238 at the edges 292 may be smaller than diameters of at least some contaminants, thereby preventing at least some of the contaminants from passing through the spaces. In another example, the interface between the plug 270 and the anode assembly 238 may act as a filter, retaining at least some contaminants thereby preventing at least some contaminants from entering the vacuum chamber 134.

Figure 6C:
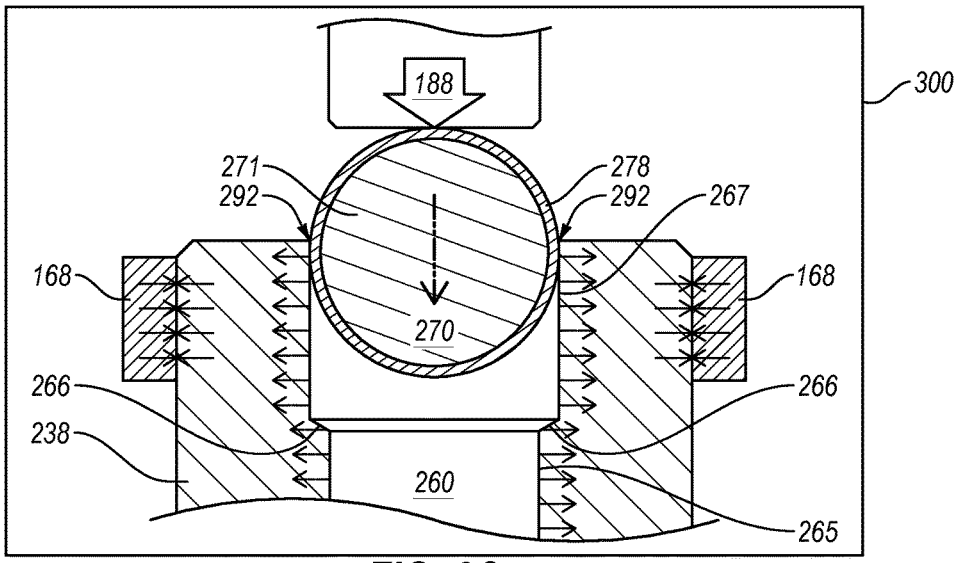

During or after evacuation, the vacuum furnace 300 may begin to heat the X-ray assembly 130 including the plug 270 and the anode assembly 238. Turning to FIG. 6C, heating will be described in further detail. Although the plug 270 may be formed of any suitable materials, in some configurations, the plug body 271 may include a material with different thermal expansion properties than the material of the anode assembly 238. Specifically, the material of the anode assembly 238 may include a coefficient of thermal expansion greater than a coefficient of thermal expansion of the material of the plug body 271. Accordingly, when heated, the material of the anode assembly 238 may expand greater than the material of the plug body 271.

As illustrated in FIG. 6C, when the anode assembly 238 is heated, the conduit 260 may expand. Specifically, at least one cross-sectional dimension of the conduit 260 may be greater after heating than at least one cross-sectional dimension of the conduit 260 before heating. Although the plug 270 also expands when heated, the plug 270 expands less than the conduit 260 when the plug body 271 is formed of a material with a lower coefficient of thermal expansion than the material of the anode assembly 238 that defines the conduit 260. In such configurations, a difference of at least one cross-sectional dimension of the plug 270 before and after heating may be less than a difference of at least one cross-sectional dimension of the conduit 260 before and after heating. Accordingly, although it may appear that the plug 270 decreases in size relative to the conduit 260, both the plug 270 and the conduit 260 expand, but the conduit 260 expands more than the plug 270, as indicated by the arrows along the walls of the conduit 260.

Although the conduit 260 may expand as a result of the thermal characteristics of the material of the anode assembly 238, the conduit 260 may, additionally or alternatively, expand as a result of force applied on the walls of the conduit 260 by the plug 270, driven by the driving member 188. Specifically, as the material of the anode assembly 238 is heated, it may soften and become more malleable. This increased malleability may permit the force of the plug 270 on the walls of the conduit 260 to deform and expand the conduit 260.

In some configurations, a support member 168 may surround a portion of the anode assembly 238. For example, the support member 168 may be an annular member surrounding the anode assembly 238 at or near the second opening 264, as illustrated in FIGS. 6A-6E. In another example, the support member 168 may be a sleeve surrounding at least a portion of the anode assembly 238. The support member 168 may be configured to support the anode assembly 238. Specifically, the support member 168 may decrease or eliminate deformation of portions of the anode assembly 238 as the anode assembly 238 becomes more malleable when it is heated. In such configurations, the support member 168 may be formed of a material that is not as malleable as the anode assembly 238 when heated. For example, the anode assembly 238 may be formed with copper and the support member 168 may be formed with steel.

Additionally or alternatively, the support member 168 may be formed of a material with different thermal expansion properties than the material of the anode assembly 238. Specifically, the material of the anode assembly 238 may include a coefficient of thermal expansion greater than a coefficient of thermal expansion of the material of the support member 168. As illustrated for example in FIG. 6C, when heated, the material of the anode assembly 238 may expand greater than the material of the support member 168. As indicated by the arrows at the interface of the support member 168 and the anode assembly 238, the support member 168 may counteract the expansion forces of the anode assembly 238. In such configurations, the support member 168 may prevent or decrease expansion of an outer diameter of the anode assembly 238. Additionally or alternatively, the support member 168 may prevent or decrease deformation of the anode assembly 238 caused by the force of the driving member 188 and/or the plug 270.

In some configurations, the support member 168 may be positioned around the anode assembly 238 before being inserted into the vacuum furnace 300. In some forms, the support member 168 may be removed after certain production steps, for example, after cooling or removal of the X-ray assembly 130 from the vacuum furnace 300. In other forms, the support member 168 may be retained after production and may be included in the completed X-ray assembly 130.

As illustrated for example in FIG. 6C, as the anode assembly 238 and the plug 270 continue to increase in temperature, the conduit 260 may expand such that the plug 270 may be pushed further and further into the conduit 260 by the driving member 188. Specifically, at least one cross-sectional dimension of the third portion 267 of the conduit 260 may expand to be substantially equal to or greater than at least one corresponding dimension of the plug 270. In some configurations, the plug 270 may be permitted to travel into the conduit 260 when heated to a temperature between 650° C. and 700° C. In some configurations, the plug 270 may be permitted to travel into the conduit 260 when heated to a temperature above 400° C., 450° C., 500° C. or 600° C. or within a range of plus and/or minus 1%, 5%, 10%, 25%, 50%, 75%, and/or 100% of 400° C., 450° C., 500° C. or 600° C.

The plug 270 may continue to travel into the conduit 260 until a majority or all of the plug 270 is positioned inside of the conduit 260. As illustrated for example in FIG. 6D, the conduit 260 may be configured to interface with the plug 270 to stop the plug 270 from being inserted into the conduit 260 further than a desired distance. The second portion 265 may be narrower than the third portion 267. At least one cross-sectional dimension of the second portion 265 may be less than at least one corresponding cross-sectional dimension of the plug 270. The taper 266 may be positioned a distance from the second opening 264 equal to the third portion 267. The size (e.g., one or more dimensions) of the third portion 267 may generally correspond to the size of the plug 270 (e.g., one or more dimensions of the plug 270). When the plug 270 incidents the taper 266, the plug 270 is stopped from being positioned further into the conduit 260. As illustrated for example in FIG. 6D, at least a portion of the plug 270 may extend into the second portion 265.

The coating 278 may be formed of any suitable materials. In some configurations, the coating 278 may include a material suitable for forming bonds such as diffusion bonds with the anode assembly 238. For example, in some configurations, the coating 278 may include, silver, gold, lead and/or nickel. The coating 278 may be positioned around at least a portion of the plug body 271. In other configurations, the coating 278 may include a material suitable for forming solder bonds with the anode assembly 238. Additionally or alternatively, the coating 278 may include a material that contributes to decreasing friction between the walls of the conduit 260 and the surface of the plug 270 as the plug 270 travels into the conduit 260. In some forms, the coating 278 may include a non-stick coating such as an oxide or chrome oxide.

In some configurations, at least a portion of the conduit 260 may include a coating with similar aspects as described with respect to the coating 278 in addition to or instead of the coating 278. For example, the third portion 267 of the conduit 260 may include a coating configured to decrease friction between the walls of the conduit 260 and the surface of the plug 270, such as an oxide or chrome oxide. In another example, at least a portion of the conduit 260, such as the third portion 267, may include a material suitable for forming bonds such as diffusion bonds with the plug 270. In some configurations, coatings on the plug 270 and/or the walls of the conduit 260 may be omitted and the anode assembly 238 and/or the plug body 271 may include a material suitable for forming bonds such as diffusion bonds, and/or a material configured to decrease friction, as described above.

As the anode assembly 238 and the plug 270 continue to increase in temperature, bonds such as diffusion bonds may be begin to form at the interface of the anode assembly 238 and the plug 270, specifically, at the third portion 267 of the conduit 260. Bonding may be influenced by the interaction of the material of the anode assembly 238 with the plug 270 and/or the coating 278. Additionally or alternatively, bonding may be influenced by the temperature and/or pressure at the interface.

In some configurations, the material included in the anode assembly 238, the plug 270, and/or the coating 278 may be selected to form bonds at a certain temperature. In some configurations, the material included in the anode assembly 238, the plug 270, and/or the coating 278 may be selected to form bonds when heated between 650° C. and 700° C. In some configurations, the material included in the anode assembly 238, the plug 270, and/or the coating 278 may be selected to form bonds when heated above 500° C., or 500° C. plus and/or minus 1%, 5%, 10%, 25%, 50%, 75%, and/or 100%.

Figure 6D:
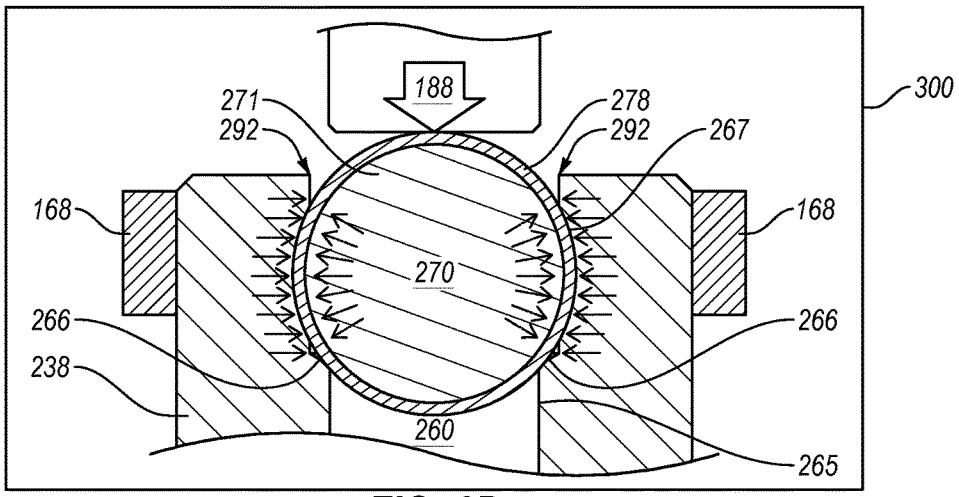
Figure 6E:
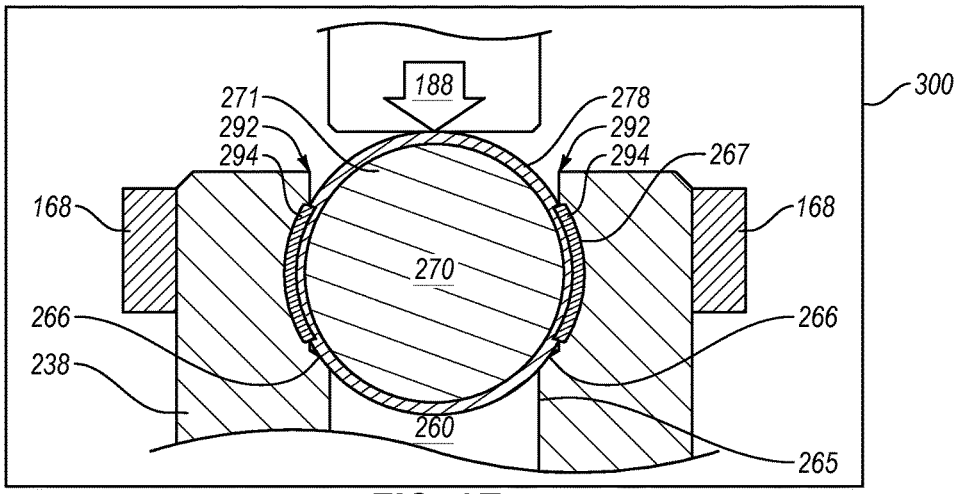

With continued reference to FIG. 6D, the anode assembly 238 and the plug 270 may be cooled after heating. As the plug 270 and the anode assembly 238 are cooled, the conduit 260 and the plug 270 may decrease in size as a result of thermal contraction. However, when the plug 270 includes a material with different thermal expansion properties than the material of the anode assembly 238, the conduit 260 and the plug 270 may decrease in size at different rates when cooled. Specifically, when the material of the anode assembly 238 includes a coefficient of thermal expansion greater than a coefficient of thermal expansion of the material of the plug 270, as the plug 270 and the conduit 260 are cooled, the conduit 260 may decrease in size more than and the plug 270 decreases in size. This may cause pressure at the interface of the anode assembly 238 and the plug 270 at the third portion 267 of the conduit 260, as indicated by the arrows in FIG. 6D. Pressure at the interface of the anode assembly 238 and the plug 270 may contribute to bonding the anode assembly 238 with the plug 270.

As illustrated for example in FIG. 6D, in configurations where the plug 270 is more malleable than the anode assembly 238 at certain temperatures, the expansion of the material of the plug 270 relative to the conduit 260 may deform the walls of the conduit 260 at the third portion 267. Deformation of the walls of the conduit 260 may contribute to bonding between the anode assembly 238 and the plug 270.

As illustrated in FIG. 6D, the anode assembly 238 and the plug 270 may continue to cool and a bond 294 may be formed between the anode assembly 238 and the plug 270 at the third portion 267 of the conduit 260. In some configurations, the bond 294 may be a diffusion bond or a crush seal bond. In some circumstances, the bond 294 may be an intermetallic layer. In some circumstances, the bond 294 may be airtight, substantially airtight, hermetic, and/or semi-hermetic. In some circumstances, the support member 168 may contribute to forming the bond 294. For example, as the support member 168 cools it may decrease in size more rapidly than the anode assembly 238, thereby directing a force against the anode assembly 238 that may contribute in decreasing the size of the conduit 260 and/or the pressure at the interface of the anode assembly 238 and the plug 270.

As discussed above, the getter 186 may be configured to be selectively activated. The getter 186 may be selectively activated during or after formation of the seal 178*a* and/or the bond 294. In one example, if the getter 186 is configured to be activated by heat, heating by the vacuum furnace 300 may activate the getter 186. In another example, if the getter 186 is configured to be activated by electric current, the getter 186 may be activated by directing current through the getter 186. When the getter 186 is activated, the getter 186 reacts with substances remaining in the vacuum chamber 134 after evacuation. The getter 186 may remove gases and/or other substances from the vacuum chamber 134. The getter 186 may increase the vacuum level of the vacuum chamber 134. In some circumstances, activating the getter 186 may generate a higher level vacuum in the vacuum chamber 134 than would otherwise be possible using only the vacuum furnace 300. For example, if the pressure inside of the vacuum furnace 300 is around $5\times10^{-6}$ Torr, then the pressure inside of the vacuum chamber 134 may be $5\times10^{-8}$ Torr. This pressure difference may be attributable to one or both of: the activated getter 186 removing gases and/or the cooling of the X-ray assembly 130 and/or the vacuum chamber 134. Activating the getter 186 after the vacuum chamber 134 is sealed may decrease the amount of reactive material of the getter 186 that is reacted during processing. In some circumstances, activating the getter 186 after the vacuum chamber 134 is sealed may prevent the reactive material of the getter 186 to be reacted during processing.

Although some of the vacuum assemblies and vacuum chambers disclosed relate to X-ray assemblies, the disclosed concepts may be applied in other operating environments to produce vacuum chambers. For example, the disclosed concepts may be applied in producing vacuum assemblies for microwave tubes, thermionic valve assemblies, lightning arrestors, vacuum circuit breakers, as well as many other applications.

When the disclosed concepts are applied in producing X-ray assemblies for X-ray fluorescence instruments, the resulting X-ray assemblies may exhibit desirable spectral characteristics with low spectral impurities. Additionally or alternatively, contaminants that interfere with the operation of the X-ray assemblies may be reduced or eliminated. Additionally or alternatively, the disclosed concepts may facilitate cost-effective production of X-ray assemblies with low contamination. Additionally or alternatively, the disclosed concepts may permit vacuum chambers of X-ray assemblies to be evacuated at rapid rates while reducing contamination. Additionally or alternatively, the disclosed concepts may facilitate production of high quality X-ray assemblies with decreased imperfections, manufacturing defects, and/or rates of imperfection and/or defects during production.

Although in the illustrated examples the conduits 160, 260 extend through the anode assemblies, 138, 238, in non-illustrated configurations the conduits may be positioned on any suitable portion of the X-ray assembly 130 defining the vacuum chamber 134. Furthermore, the disclosed concepts may be applied in producing vacuum assemblies with conduits and corresponding plugs in any suitable position.

The disclosed devices and methods may be used to facilitate production of high quality vacuum chambers. Specifically, the disclosed concepts may facilitate production of vacuum assemblies and vacuum chambers with decreased contamination. Additionally or alternatively, the disclosed concepts may facilitate production of vacuum assemblies and vacuum chambers with very low internal pressure. Additionally or alternatively, the disclosed concepts may facilitate cost-effective production of high quality vacuum assemblies and high quality vacuum chambers. Additionally or alternatively, the disclosed concepts may facilitate evacuation of vacuum chambers of vacuum assemblies at rapid rates.

The disclosed devices and methods may be used to facilitate production of vacuum assemblies using vacuum furnaces. Although vacuum furnaces may include low level of contaminants, vacuum furnaces may still include some contaminants. In some circumstances, even low levels of contaminants may be undesirable. For example, vacuum furnaces may include higher levels of contaminants than a clean room. The disclosed concepts may decrease or eliminate contaminants entering vacuum chambers from vacuum furnaces during processing. When vacuum assemblies including the disclosed conduits and corresponding plugs are assembled in a clean room prior to processing in vacuum furnaces, vacuum chambers may include lower levels of contaminants than the vacuum furnaces.

In some aspects, a method for forming a vacuum in a vacuum assembly may include providing the vacuum assembly defining an internal vacuum chamber in fluid communication with an exterior of the vacuum assembly via a conduit in the vacuum assembly between the vacuum chamber and the exterior of the vacuum assembly. The method may include positioning a plug to at least partially occlude the conduit such that at least one space between the plug and the vacuum assembly permits fluid to travel between the vacuum chamber and the exterior of the vacuum assembly. The method may include evacuating the vacuum chamber so that gas in the vacuum chamber exits the vacuum chamber through at least one space between the plug and the vacuum assembly. The method may include sealing the evacuated vacuum chamber with the plug such that the vacuum chamber is sealed from the exterior of the vacuum assembly.

In some configurations, the method may include assembling at least a portion of the vacuum assembly in a clean room environment prior to positioning the plug to at least partially occlude the conduit. In some configurations, the method may include removing contaminants from at least a portion of the vacuum assembly in the clean room environment prior to positioning the plug to at least partially occlude the conduit. In some configurations, the method may include positioning the plug to at least partially occlude the conduit in a clean room environment. In some configurations, the method may include positioning the plug so that at least one interface member is positioned at an interface between the plug and the vacuum assembly.

In some aspects of the method, at least one interface member may include a meltable material configured to form a bond between the plug and the vacuum assembly. In some configurations, the method may include heating to melt the material and/or positioning the plug further into the conduit.

In some aspects of the method, the meltable material is a braze alloy. In some configurations, sealing includes brazing the plug and the vacuum assembly with the braze alloy. In some configurations, sealing includes cooling at least a portion of the plug and the vacuum assembly to form a braze seal from the braze alloy between the plug and the vacuum assembly.

In some aspects of the method, the plug includes a shoulder and the conduit includes a taper between a narrower conduit portion and a wider conduit portion. In some aspects, the taper may be configured to interface with the shoulder. In some configurations, the method may include positioning the plug at least partially inside of the conduit such that the shoulder interfaces with the taper.

In some aspects of the method, the plug may be spherical and the conduit may include a taper between a narrower conduit portion and a wider conduit portion, and/or the taper may be configured to interface with the plug. In some configurations, the method may include positioning the plug at least partially inside of the conduit such that the plug interfaces with the taper.

In some aspects of the method, at least a portion of the plug may include a first material and at least a portion of the vacuum assembly that defines the conduit may be formed of a second material with greater thermal expansion characteristics than the first material. In some configurations, the method may include heating such that the conduit expands more relative to the plug.

In some aspects of the method, the plug may include a dimension greater than a cross-sectional dimension of the conduit before heating and the heating may expand the cross-sectional dimension more relative to the plug such that the plug may be positioned further into the conduit. In some configurations, the method may include positioning the plug further into the conduit.

In some configurations, sealing of the vacuum chamber may include cooling at least a portion of the plug and the vacuum assembly such that the conduit contracts more relative to the plug. In some configurations, the sealing of the vacuum chamber includes forming a diffusion bond at an interface of the plug and the vacuum assembly.

In some aspects of the method, the plug may include a plug body and a coating that surrounds at least a portion of the plug body. The coating may include one or more of the following: a material suitable for forming diffusion bonds with the vacuum assembly and/or a material configured to contribute to decreasing friction between at least on wall of the conduit and a surface of the plug.

In some configurations, the method may include positioning a getter within the vacuum chamber and activating the getter. In some configurations, the method may include positioning the vacuum assembly inside of a vacuum furnace before evacuating the vacuum chamber. In some aspects, the vacuum furnace may evacuate the vacuum chamber and heats at least a portion of the plug or the vacuum assembly.

In one example embodiment, a vacuum assembly may include a body defining a vacuum chamber, a conduit in the body extending between the vacuum chamber and an exterior of the body, and a plug at least partially occluding the conduit so as to form at least one space between the plug and the body.

In some configurations, the plug may be configured to one or more of the following: permit gaseous fluid to be evacuated from the vacuum chamber; not to permit at least some particles to enter the vacuum chamber; and/or seal the vacuum chamber when heated.

In some configurations, the plug may include at least one interface member including a braze alloy surrounding at least a portion of the plug. The interface member may define a portion of the at least one space between the plug and the body.

In some configurations, the plug may include a coating including a material configured to form a diffusion bond with the body.

In some configurations of the vacuum assembly, at least a portion of the plug may include a first material and at least a portion of the body that defines the conduit may include a second material with greater thermal expansion characteristics than the first material. In some configurations, the plug may include a first dimension greater than a cross-sectional dimension of the conduit at a first temperature and/or the plug may include a second dimension greater than the first dimension at a second temperature.

In another example embodiment, a kit may include a vacuum assembly including a body defining a vacuum chamber in fluid communication with an exterior of the vacuum assembly via a conduit in the body between the vacuum chamber and the exterior of the vacuum assembly, and a plug configured to be positioned to at least partially occlude the conduit such that at least one space between the plug and at least one wall of the conduit permits gaseous fluid to be evacuated from the vacuum chamber and does not permit at least some particles to enter the vacuum chamber.

In some configurations, the plug may include at least one interface member including a braze alloy surrounding at least a portion of the plug. In some configurations, the plug may include a coating including a material configured to form a diffusion bond with the wall of the conduit.

In some configurations of the kit, at least a portion of the plug may include a first material and at least a portion of the body that defines the conduit may include a second material with greater thermal expansion characteristics than the first material. In some configurations, the plug may include a first dimension greater than a cross-sectional dimension of the conduit at a first temperature and/or the plug may include a second dimension greater than the first dimension at a second temperature.

In yet another example embodiment, a vacuum assembly may include a body defining an evacuated vacuum chamber, a conduit in the body extending between the vacuum chamber and an exterior of the body, a plug at least partially occluding the conduit, and a seal between the plug and the body that seals the vacuum chamber from the exterior of the body.

In some configurations of the vacuum assembly, the seal may be a braze seal formed of a braze alloy melted to form a bond between the plug and the body.

In some configurations of the vacuum assembly, at least a portion of the plug may include a first material and at least a portion of the body that defines the conduit may include a second material with greater thermal expansion characteristics than the first material. In some configurations, the seal may be a diffusion bond formed at an interface of the plug and the body.

In still another example embodiment, an X-ray assembly configured to emit X-rays may include any one or more of the above mentioned aspects or features. In some configurations, the X-ray assembly may include an anode assembly with a target defining an X-ray emission face. In some configurations, the anode assembly may define the conduit. In some configurations, the X-ray assembly may include a cathode assembly that defines an electron emission face and may include an electron emitter configured to emit electrons when energized. In some configurations, the X-ray assembly may include an X-ray emission window positioned at an end of the X-ray assembly. In some configurations, the vacuum assembly may surround at least a portion of the anode assembly and the cathode assembly within the vacuum chamber.

The terms and words used in this description and claims are not limited to the bibliographical meanings, but, are merely used to enable a clear and consistent understanding of the disclosure. It is to be understood that the singular forms "a," "an," and "the" include plural referents unless the context clearly dictates otherwise. Thus, for example, reference to "a component surface" includes reference to one or more of such surfaces.

The term "substantially" means that the recited characteristic, parameter, or value need not be achieved exactly, but that deviations or variations, including for example, tolerances, measurement error, measurement accuracy limitations and other factors known to those skilled in the art, may occur in amounts that do not preclude the effect the characteristic was intended to provide.

Aspects of the present disclosure may be embodied in other forms without departing from its spirit or essential characteristics. The described aspects are to be considered in all respects illustrative and not restrictive. The claimed subject matter is indicated by the appended claims rather than by the foregoing description. All changes which come within the meaning and range of equivalency of the claims are to be embraced within their scope.

What is claimed is:

1. A method for forming a vacuum in a vacuum assembly for an X-ray device, the method comprising:

providing the vacuum assembly defining an internal vacuum chamber in fluid communication with an exterior of the vacuum assembly via a conduit in the vacuum assembly between the vacuum chamber and the exterior of the vacuum assembly;

positioning a plug to at least partially occlude the conduit such that at least one space between the plug and the vacuum assembly permits fluid to travel between the vacuum chamber and the exterior of the vacuum assembly;

evacuating the vacuum chamber so that gas in the vacuum chamber exits the vacuum chamber through the at least one space between the plug and the vacuum assembly;

positioning the plug further into the conduit; and sealing the evacuated vacuum chamber with the plug such that the vacuum chamber is sealed from the exterior of the vacuum assembly.

2. The method of claim 1, further comprising assembling at least a portion of the vacuum assembly in a clean room environment prior to positioning the plug to at least partially occlude the conduit.

3. The method of claim 2, further comprising removing contaminants from at least a portion of the vacuum assembly in the clean room environment prior to positioning the plug to at least partially occlude the conduit.

4. The method of claim 3, further comprising positioning the plug to at least partially occlude the conduit in a clean room environment.

5. The method of claim 1, further comprising positioning the plug so that at least one interface member is positioned at an interface between the plug and the vacuum assembly.

6. The method of claim 5, wherein the at least one interface member includes a meltable material configured to form a bond between the plug and the vacuum assembly, the method further comprising heating to melt the material.

7. The method of claim 6, wherein the meltable material is a braze alloy and the sealing further comprises:

brazing the plug and the vacuum assembly with the braze alloy; and cooling at least a portion of the plug and the vacuum assembly to form a braze seal from the braze alloy between the plug and the vacuum assembly.

8. The method of claim 7, wherein the plug includes a shoulder and the conduit includes a taper between a narrower conduit portion and a wider conduit portion, the taper configured to interface with the shoulder, the method further comprising positioning the plug at least partially inside of the conduit such that the shoulder interfaces with the taper.

9. The method of claim 1, wherein the plug is spherical and the conduit includes a taper between a narrower conduit portion and a wider conduit portion, the taper configured to interface with the plug, the method further comprising positioning the plug at least partially inside of the conduit such that the plug interfaces with the taper.

10. The method of claim 1, wherein at least a portion of the plug includes a first material and at least a portion of the vacuum assembly that defines the conduit includes a second material with greater thermal expansion characteristics than the first material, further comprising heating such that the conduit expands more relative to the plug.

11. The method of claim 10, wherein the plug includes a dimension greater than a cross-sectional dimension of the conduit before heating and the heating expands the cross-sectional dimension more relative to the plug such that the plug may be positioned further into the conduit, further comprising positioning the plug further into the conduit.

12. The method of claim 11, the sealing of the vacuum chamber further comprising cooling at least a portion of the plug and the vacuum assembly such that the conduit contracts more relative to the plug.

13. The method of claim 12, the sealing of the vacuum chamber further comprising forming a diffusion bond at an interface of the plug and the vacuum assembly.

14. The method of claim 1, wherein the plug includes a plug body and a coating that surrounds at least a portion of the plug body, the coating including one or more of the following: a material suitable for forming diffusion bonds with the vacuum assembly and/or a material configured to contribute to decreasing friction between at least on wall of the conduit and a surface of the plug.

15. The method of claim 1, further comprising positioning a getter within the vacuum chamber and activating the getter.

16. The method of claim 1, further comprising positioning the vacuum assembly inside of a vacuum furnace before evacuating the vacuum chamber, wherein the vacuum furnace evacuates the vacuum chamber and heats at least a portion of the plug or the vacuum assembly.

17. An X-ray assembly comprising:

an anode;

a body, wherein the anode and the body define an evacuated vacuum chamber;

a conduit extending through the anode between the interior of the vacuum chamber and an exterior of the vacuum chamber;

a plug coupled to the anode to at least partially occlude the conduit; and a seal between the plug and the anode that seals the vacuum chamber from the exterior of the vacuum chamber.

18. The X-ray assembly of claim 17, wherein the seal is a braze seal formed of a braze alloy melted to form a bond between the plug and the anode.

19. The X-ray assembly of claim 17, wherein at least a portion of the plug includes a first material, at least a portion of the anode includes a second material with greater thermal expansion characteristics than the first material, and the seal is a diffusion bond formed at an interface of the plug and the anode.

20. The X-ray assembly of claim 17, wherein the anode includes a target defining an X-ray emission face;

further comprising:

a cathode assembly that defines an electron emission face and includes an electron emitter configured to emit electrons when energized; and an X-ray emission window positioned at an end of the X-ray assembly;

wherein the vacuum assembly surrounds at least a portion of the anode and the cathode assembly within the vacuum chamber.

* * * * *